US009953598B2

(12) United States Patent
Lee

(10) Patent No.: US 9,953,598 B2
(45) Date of Patent: Apr. 24, 2018

(54) METHOD OF CONTROLLING DISPLAY DRIVER IC WITH IMPROVED NOISE CHARACTERISTICS

(71) Applicant: Samsung Electronics Co., Ltd., Suwon-si, Gyeonggi-do (KR)

(72) Inventor: Sang-Min Lee, Seongnam-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 183 days.

(21) Appl. No.: 14/723,636

(22) Filed: May 28, 2015

(65) Prior Publication Data

US 2015/0348485 A1 Dec. 3, 2015

Related U.S. Application Data

(60) Provisional application No. 62/004,330, filed on May 9, 2014.

(30) Foreign Application Priority Data

Nov. 5, 2014 (KR) ..... 10-2014-0153077

(51) Int. Cl.
*G09G 5/00* (2006.01)
*G09G 3/36* (2006.01)

(52) U.S. Cl.
CPC ..... *G09G 3/3648* (2013.01); *G09G 3/3611* (2013.01); *G09G 5/003* (2013.01); *G09G 2370/08* (2013.01)

(58) Field of Classification Search
CPC .... G09G 3/3648; G09G 5/003; G09G 3/3611; G09G 2370/08
USPC ..... 345/214
See application file for complete search history.

(56) References Cited

U.S. PATENT DOCUMENTS

| | | | | |
|---|---|---|---|---|
| 7,069,590 | B1 * | 6/2006 | Malvar | H04K 1/02 348/E7.056 |
| 7,579,887 | B1 | 8/2009 | Friedman et al. | |
| 8,120,591 | B2 | 2/2012 | Krah et al. | |
| 8,164,367 | B1 | 4/2012 | Bal et al. | |
| 8,416,461 | B2 | 4/2013 | Nakazawa | |
| 8,482,325 | B2 | 7/2013 | Ohmine | |
| 8,649,416 | B2 | 2/2014 | Tanaka et al. | |
| 9,111,339 | B1 * | 8/2015 | Huang | G06T 5/002 |
| 2003/0160899 | A1 * | 8/2003 | Ngai | H04N 19/80 348/607 |
| 2009/0066677 | A1 * | 3/2009 | Kim | G06F 3/147 345/204 |
| 2013/0094539 | A1 | 4/2013 | Nakadaira | |
| 2013/0094603 | A1 | 4/2013 | Pandey et al. | |
| 2013/0114109 | A1 * | 5/2013 | Ohmine | G06K 15/1894 358/1.15 |
| 2013/0127505 | A1 | 5/2013 | Kanda | |
| 2013/0195218 | A1 | 8/2013 | Whitby-Strevens | |
| 2013/0279485 | A1 | 10/2013 | Gao et al. | |

(Continued)

*Primary Examiner* — Srilakshmi K Kumar
*Assistant Examiner* — Chineyere Wills-Burns
(74) *Attorney, Agent, or Firm* — Harness, Dickey & Pierce, P.L.C.

(57) ABSTRACT

Provided is a method of controlling a display driver IC. The method includes controlling an application processor to operate in a frequency range, which is changed from an operating frequency range of a preset specification and is a range in which data noise is decreased, through a plurality of frequency noise filtering operations.

9 Claims, 10 Drawing Sheets

(56) References Cited

U.S. PATENT DOCUMENTS

2013/0315397 A1 11/2013 Tuers et al.
2013/0329004 A1* 12/2013 Baqai ..... H04N 5/217
348/36

* cited by examiner

FIG. 7

| Horizontal [KHZ] | | 99.3 | 99.4 | 99.5 | 99.6 | 99.7 | 99.8 | 99.9 | 100 | 100.1 | 100.2 | 100.3 | 100.4 | 100.5 | 100.6 | 100.7 | 100.8 | 100.9 | 101 | 101.1 | 101.2 | 101.3 | 101.4 | 101.5 |
|---|---|---|---|---|---|---|---|---|---|---|---|---|---|---|---|---|---|---|---|---|---|---|---|---|
| A | 1 | | | | | | | | | | | | | | | | | | | | | | | |
| | 2 | | | | | | | | | | | | | | | | | | | | | | | |
| | 3 | | | | | | | | | | | | | | | | | | | | | | | |
| B | 1 | | | | | | | | | | | | | | | | | | | | | | | |
| | 2 | | | | | | | | | | | | | | | | | | | | | | | |
| | 3 | | | | | | | | | | | | | | | | | | | | | | | |
| C | 1 | | | | | | | | | | | | | | | | | | | | | | | |
| | 2 | | | | | | | | | | | | | | | | | | | | | | | |
| | 3 | b | a | | | | | | c | | | | | | | | | | | | | | | |

METHOD OF CONTROLLING DISPLAY DRIVER IC WITH IMPROVED NOISE CHARACTERISTICS

CROSS-REFERENCE TO RELATED APPLICATION

This application claims the benefit of provisional U.S. application No. 62/004,330 filed on May 29, 2014, and also claims priority under 35 U.S.C. § 119 to Korean Patent Application No. 10-2014-0153077 filed on Nov. 5, 2014, the disclosure of which is hereby incorporated by reference in its entirety.

BACKGROUND

Field

Some example embodiments of the inventive concepts relate to methods of controlling a display driver integrated circuit (IC), and more particularly, to methods of controlling a display driver IC with improved noise characteristics.

Description of Related Art

The display driver IC (DDI) is a drive chip of a liquid crystal display (LCD) device.

Image data may be transmitted via a transmission channel between the DDI and a timing controller (TCON) provided in the LCD device.

Currently, a frequency of a channel is not varied according to a surrounding frequency environment of the rapidly changing DDI or a drive condition.

SUMMARY

Some example embodiments of the inventive concepts provide methods of controlling a display driver integrated circuit (IC) capable of controlling an operation thereof in a frequency band where noise is decreased.

In accordance with an example embodiment of the inventive concepts, a method of controlling the display driver integrated circuit (IC) includes controlling an application processor to operate in a frequency range which is changed from an operating frequency range of a preset specification and is a range in which data noise is decreased, through a plurality of frequency noise filtering operations.

In an example embodiment, the plurality of frequency noise filtering operations may include performing a first frequency noise filtering operation, selectively performing a second frequency noise filtering operation, and selectively performing a third frequency noise filtering operation.

In an example embodiment, the first frequency noise filtering operation may be performed using a data scramble.

In an example embodiment, the second frequency noise filtering operation may be performed using a spread spectrum clock generation technology.

In an example embodiment, the third frequency noise filtering operation may include checking data noise at intervals of a frequency unit and detecting minimum and maximum values of the operating frequency.

In accordance with another example of the inventive concepts, a method of controlling a display driver IC includes changing an operating frequency of data transmitted from an application processor to a timing controller, from the timing controller to a source driver, and from the timing controller to a gate driver to a new frequency range in response to a communication environment.

In an example embodiment, the method may further include performing a frequency noise filtering operation to detect a frequency range where noise is decreased with respect to each of a first frequency, a second frequency, and a third frequency when an operating frequency between the application processor and the timing controller is referred to as the first frequency, an operating frequency between the timing controller and the source driver is referred to as the second frequency and an operating frequency between the timing controller and the gate driver is referred to as the third frequency.

In an example embodiment, the performing of the frequency noise filtering operation may include performing a first frequency noise filtering operation, selectively performing a second frequency noise filtering operation, and selectively performing a third frequency noise filtering operation.

In an example embodiment, the method may further include performing the second frequency noise filtering operation when a frequency range, where the noise is decreased, is not sufficiently filtered through the first frequency noise filtering operation.

In an example embodiment, the method may further include performing the third frequency noise filtering operation when a frequency range, where the noise is decreased, is not sufficiently filtered through the second frequency noise filtering operation.

In an example embodiment, the first frequency noise filtering operation may be performed using a data scramble.

In an example embodiment, the second frequency noise filtering operation may be performed using a spread spectrum clock generation technology.

In an example embodiment, the spread spectrum clock generation technology may include setting each of the first to third frequencies to a basic frequency and spreading a clock with a modulation ratio.

In an example embodiment, the third frequency noise filtering operation may include checking data noise at intervals of a desired (or, alternatively predetermined) frequency unit and detecting minimum and maximum values of a corresponding operating frequency.

In an example embodiment, the third frequency noise filtering operation may be performed using software or hardware.

In accordance with still another example of the inventive concepts, a method of controlling a display driver IC includes performing data transmission between an application processor and a display module in an operating frequency range which is changed to a frequency range where noise is decreased, wherein the display module may feedback of information of a substantial operating frequency to the application processor.

In an example embodiment, the provision of the feedback may include reducing the changed frequency range of the application processor.

In an example embodiment, the application processor is operated in a changed operating frequency range different from an operating frequency range of a preset specification through a first frequency noise filtering operation, a second frequency noise filtering operation, and a third frequency noise filtering operation.

In an example embodiment, the first frequency noise filtering operation, the second frequency noise filtering operation, and the third frequency noise filtering operation may include referring to a range of the substantial operating frequency provided by the feedback.

In example embodiment, the plurality of frequency noise filtering operations may include performing a subsequent filtering operation when a frequency range, where noise is decreased, is undetected at a corresponding filtering operation.

In another embodiment, the method includes changing an operating frequency of data transmitted from an first element to a second element to reduce noise.

For example, the changing includes performing a first noise filtering operation on the operating frequency, performing a second noise filtering operation on output the first noise filtering operation if the first noise filtering operation does not sufficiently reduce noise; and performing a third noise filtering operation on output of the second noise filtering operation if the second noise filtering operation does not sufficiently reduce noise.

In one embodiment, the first noise filtering operation is performed using a data scramble; the second noise filtering operation is performed using a spread spectrum clock generation technology; and the third noise filtering operation comprises checking data noise at intervals of a frequency unit and detecting minimum and maximum values of a corresponding operating frequency.

BRIEF DESCRIPTION OF THE DRAWINGS

The foregoing and other features and advantages of the inventive concepts will be apparent from the more particular description of example embodiments of the inventive concepts, as illustrated in the accompanying drawings in which like reference characters refer to the same parts throughout the different views. The drawings are not necessarily to scale, emphasis instead being placed upon illustrating the principles of the inventive concepts. In the drawings:

FIG. 7 is a simulation diagram for analyzing noise characteristics in the application processor;

DETAILED DESCRIPTION OF EXAMPLE EMBODIMENTS

Figure 1:
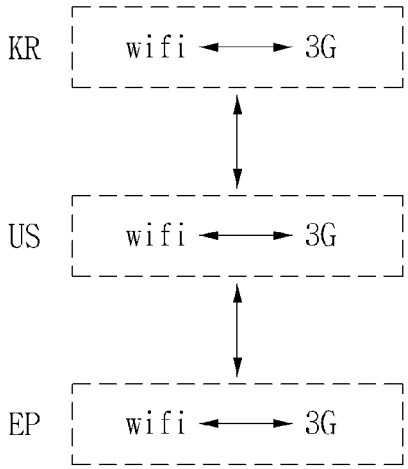
FIG. 1 (PRIOR ART)
FIG. 1 is a conceptual block diagram of a general country-specific mobile device communication environment.

Hereinafter, various embodiments will now be described more fully with reference to the accompanying drawings in which some embodiments are shown so that this disclosure is thorough and complete and fully conveys the inventive concepts to those skilled in the art. The descriptions of constructions unrelated to the inventive concepts may be omitted. In adding reference numerals to the drawings, like reference numerals refer to like elements throughout the different views.

Disclosures of specific structure or function in the embodiments of the inventive concepts is only for the purpose of explaining embodiments of the inventive concepts as examples, and the inventive concepts may be embodied in different forms and should not be construed as limited to the embodiments set forth herein.

Various modifications and forms may be included, but specific embodiments are illustrated in the drawings and are described in detail. However, the inventive concepts is not to be construed as limited to the specific embodiments disclosed, and it is to be understood to include all modifications, equivalents or substitutes in the scope of the present inventive concepts.

It will be understood that, although the terms "first," "second," etc. may be used herein to describe various components, these components should not be limited by these terms. These terms are only used to distinguish one component from another component. Thus, a first component discussed below could be termed a second component and the second component discussed below could be termed the first component without departing from the teachings of the present inventive concepts.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Expressions explaining a relationship between elements, i.e., "between" and "directly between" or "adjacent" and "directly adjacent" may be understood likewise.

The terminology used herein is for the purpose of describing particular embodiments only and is not intended to be limiting of the present inventive concepts. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this inventive concepts belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Meanwhile, when it is possible to implement any embodiment in any other way, a function or an operation specified in a specific block may be performed differently from a flow specified in a flowchart. For example, two consecutive blocks may actually perform the function or the operation simultaneously, and the two blocks may perform the function or the operation conversely according to a related operation or function.

Hereinafter, embodiments of the inventive concepts will be described with reference to the accompanying drawings.

FIG. 1 is a conceptual block diagram of a general country-specific mobile device communication environment.

Referring to FIG. 1, a mobile device supports by both 3G (generation) and WiFi, the mobile device may be operate at a WiFi frequency and a 3G in one country; for example, the Republic of Korea. For example, the WiFi frequency may be 2 GHz and the 3G frequency may be in a range of 900 MHz to 1 GHz.

In another country, for example, the USA, a user may use a mobile device which supports WiFi frequency and 3G frequency according to a base transceiver station environment of the USA.

In yet another region, for example, Europe, a user may use a mobile device which supports WiFi frequency and 3G frequency according to a base transceiver station environment of the user's own country.

The mobile device should operate well in the frequency environments of the other countries or regions. However, image quality and communication quality may decrease due to the influence of noise according to the base transceiver station environment of each region and country. This will be explained with reference to FIG. 2 as below.

Figure 2:
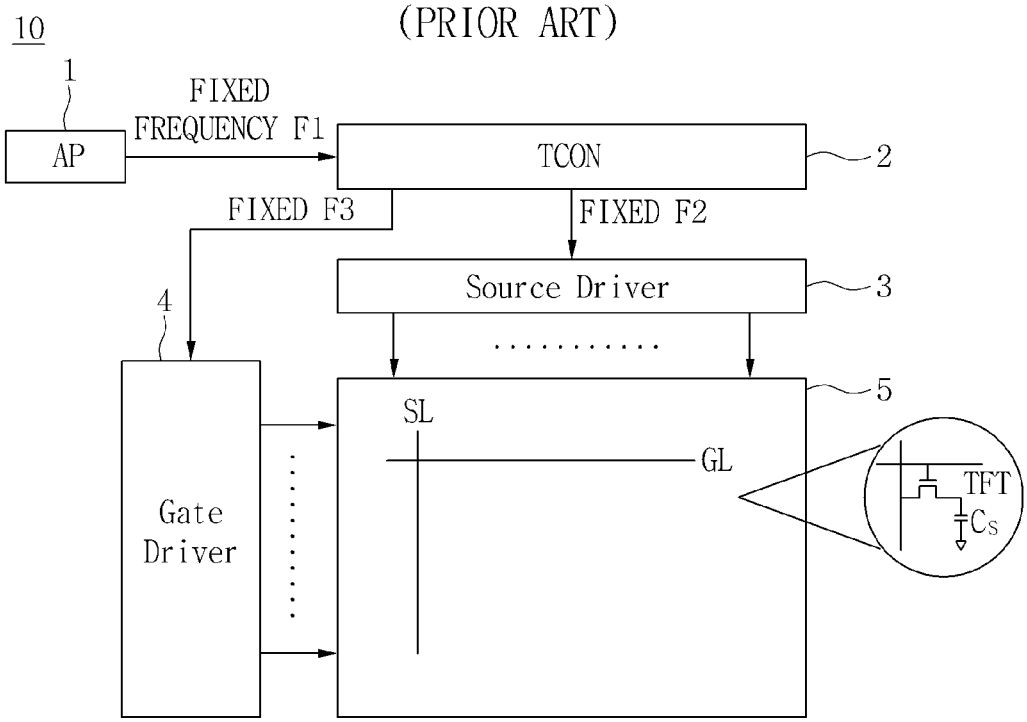
FIG. 2 (PRIOR ART)
FIG. 2 is a block diagram briefly illustrating a general display driver IC (DDI)

FIG. 2 is a block diagram briefly illustrating a general display driver IC (DDI).

Referring to FIG. 2, a DDI 10 includes an application processor (AP) 1, a timing controller (TCON) 2, a source driver 3, a gate driver 4, and a panel 5.

The AP 1 serves as a CPU which supports and controls overall operations of the DDI 10. The AP 1 detects a surrounding communication environment and provides data to the TCON 2 to support an operation corresponding to the environment. That is, the AP 1 may set an internal operating frequency to a frequency band suitable for a peripheral base station.

Here, when a frequency for transmitting data from the AP 1 to the TCON 2 is referred to as a first frequency or frequency band F1, the first frequency F1 is a fixed frequency or band.

Subsequently, the TCON 2 receives image data and various control signals from the outside and controls operations of the source driver 3 and the gate driver 4. Although not illustrated, the various control signals may include a horizontal sync signal, a vertical sync signal, a clock signal, etc.

The TCON 2, for example, outputs general control signals such as a drive signal for controlling the gate driver 4 and a drive signal for controlling the source driver 3 to control whether the gate driver 4 and the source driver 3 operate or not, respectively.

Therefore, in a desired (or, alternatively a predetermined) operation mode, the TCON 2 may control the gate driver 4 so that the gate driver 4 drives gate lines GL in a continuous manner. Furthermore, the TCON 2 may control image data signals such as R (Red), G (Green), B (Blue) signals, which are input from the outside, to be applied selectively to each pixel arranged in the gate lines, which are sequentially activated.

Therefore, the TCON 2 may provide a control signal to the source driver 3 and the gate driver 4 by using a second frequency or frequency band F2 and a third frequency or frequency band F3, respectively. Here, the second frequency F2 and the third frequency F3 may be fixed frequencies or bands, similar to first frequency F1.

The source driver 3 includes a plurality of output amplifiers configured to drive source lines SL. The source driver 3 is controlled by the TCON 2 and transmits the image data (R, G, and B), i.e., pixel data, to the source lines SL of the panel 5. Therefore, the source driver 3 may control the pixel data to display full colors through a combination of R, G, and B pixels. The source driver 3 may provide the pixel data through a period of the second frequency F2.

The gate driver 4 includes a plurality of gate drivers configured to drive the gate lines GL in the panel 5. The gate driver 4 sequentially inputs a gate turn-on voltage to the gate lines GL. In this way, the gate driver 4 may control whether a corresponding cell transistor is turned on so that a gray-scale voltage to be applied to each pixel is applied to the corresponding pixel. The gate driver 4 may provide a clocking signal of the gate lines GL through a period of the third frequency F3.

The panel 5 includes a plurality of unit pixels arranged in the form of matrix at intersections of the plurality of the gate lines GL and the plurality of the source lines SL. Pixels arranged in any one of the rows are commonly connected to any one of the gate lines GL, and pixels arranged in any one of the columns are commonly connected to any one of the source lines SL.

Considering the unit pixel as an equivalent circuit, the unit pixel includes a switching element TFT, which is connected to the gate lines GL and the sources lines SL, and a liquid crystal capacitor Cs connected to the switching element.

Conventionally, a frequency according to a communication environment of each mobile device is used with a preset frequency. For this reason, noise is generated in the frequency of a transmitting signal when the frequency environment changes according to countries and regions, thereby degrading image quality and communication quality.

That is, conventionally, since communication is performed in the fixed frequency band even when the communication environment and the base station change, communication quality becomes lower or a flicker phenomenon on an image may be generated. To reduce the noise, it has been attempted to reinforce a ground power or add a conductive tape at a final stage of a product manufacture, however, this causes a cost increase and an area efficiency of the device decreases.

Also, a method for increasing a frequency of a channel between the AP 1 and the TCON 2 is considered. However, an increase of the frequency of the channel causes an increase of the data transfer speed to be limited and an electromagnetic interference (EMI) to be increased. Furthermore, a channel extension causes an overall cost increase due to problems such as increasing the complexity on a PCB board, etc.

Figure 3:
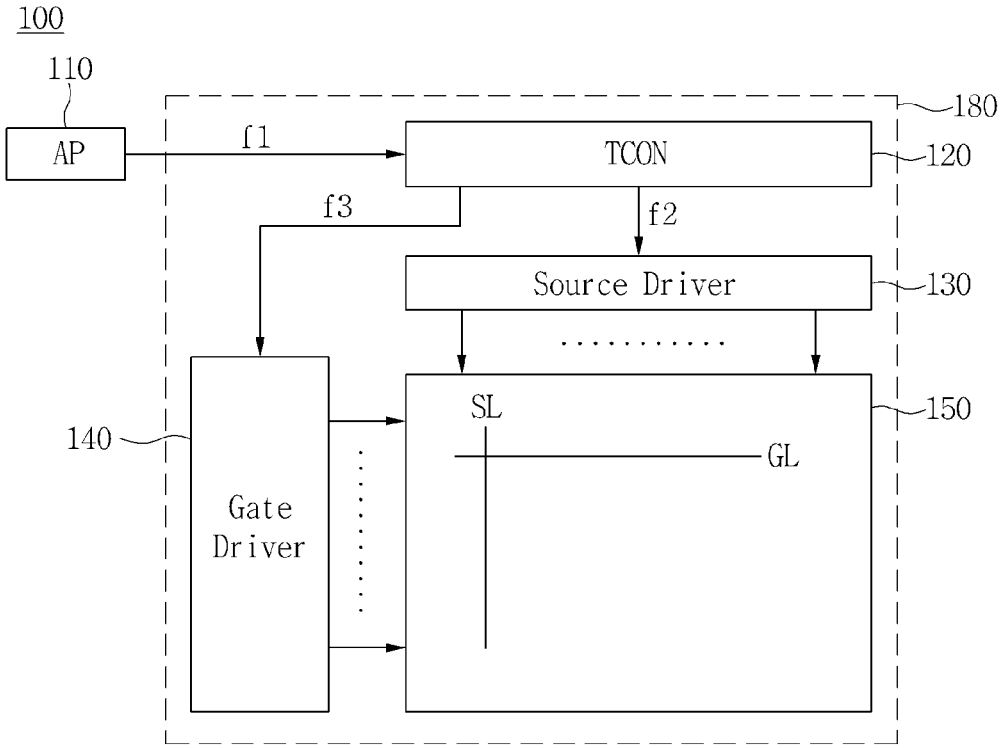
FIG. 3 is a block diagram of a DDI in accordance with an embodiment of the inventive concepts.

FIG. 3 is a block diagram of the DDI 100 in accordance with an embodiment of the inventive concepts.

Referring to FIG. 3, the DDI 100 includes the AP 110 and a display module 180. The display module 180 includes a TCON 120, a source driver 130, a gate driver 140 and a panel 150.

In the DDI 100 according to the embodiment of the inventive concepts, each data frequency transmitted from the AP 110 to the TCON 120, from the TCON 120 to the source driver 130, and from the TCON 120 to the gate driver 140 may be variable according to the communication environment. Here, respective frequencies are defined as a first frequency f1, a second frequency f2, and a third frequency f3. Thus, the DDI 100 may detect a frequency range suitable for the environment of the display module 180 and control the AP 110 to newly apply the varied first to third frequencies f1 to f3.

The AP 110 supports and controls overall operations of the DDI 100. The AP 110 detects a surrounding communication environment and transmits the detected data to the TCON 120 to support an operation corresponding to the environment.

Here, when a data transmission frequency from the AP 110 to the TCON 120 is referred to as the first frequency or band f1, the first frequency f1 or band may be a varied frequency in consideration of an operation status of the TCON 120.

That is, the AP 110 may search for a frequency band, where noise is substantially decreased, in a basic frequency band required for transmitting data or signals, and transmit signals to the TCON 120 using the most appropriate frequency. That is, the AP 110 may search for and may apply a frequency band of the first frequency f1 to the TCON 120.

Subsequently, the TCON 120 may receive image data and various control signals from external to control operations of the source driver 130 and the gate driver 140. Although not illustrated, the various control signals may include a horizontal sync signal, a vertical sync signal, a clock signal, etc.

The TCON 120, for example, may output general control signals such as a drive signal for controlling the gate driver 140 and a drive signal for controlling the source driver 130 to control whether the gate driver 140 and the source driver 130 operate or not, respectively. Therefore, in the desired (or, alternatively, the predetermined) operation mode, the TCON 120 may control the gate driver 140 so that the gate driver 140 drives the gate lines GL in a continuous manner. Furthermore, the TCON 120 may control image data signals, input from the outside, to be applied selectively to each pixel arranged in the gate lines GL, which are sequentially activated. Therefore, the TCON 120 may provide a control signal to the source driver 130 and the gate driver 140 using the second frequency f2 or band and third frequency or band f3, respectively. Here, the second frequency f2 and the third frequency f3 may be newly varied to within ranges of frequencies, where noise is decreased, by considering a frequency environment of the source driver 130 and the gate driver 140, similar to the first frequency f1.

Throughout this disclosure, frequency and frequency band, may be used interchangeably.

Hereinafter, general operations of the source driver 130 and the gate driver 140 will be briefly described to avoid a duplicated description since it is the same as that described in FIG. 2.

The source driver 130 may include a plurality of output amplifiers configured to drive source lines SL. The source driver 130 is controlled by the TCON 120 and provides the image data through a period of the second frequency f2.

The gate driver 140 may include a plurality of gate drivers configured to drive the gate lines GL. The gate driver 140 sequentially applies a turn-on voltage to the gate lines GL through a period of the third frequency f3.

The panel 150 may be controlled by the gate driver 140 and the source driver 130 to display images through pixels.

Referring to FIGS. 3 to 5B, a method for varying the first to the third frequencies f1 to f3 will be described in detail.

First of all, a data scramble is performed to firstly filter noise generated in each frequency.

Since a method for varying the first frequency f1, the second frequency f2 and the third frequency f3 are the same, albeit within or over different frequency ranges, the method for varying the first frequency f1 will be representative of descriptions of the methods for varying the second frequency f2 and the third frequency f3.

Figure 4:
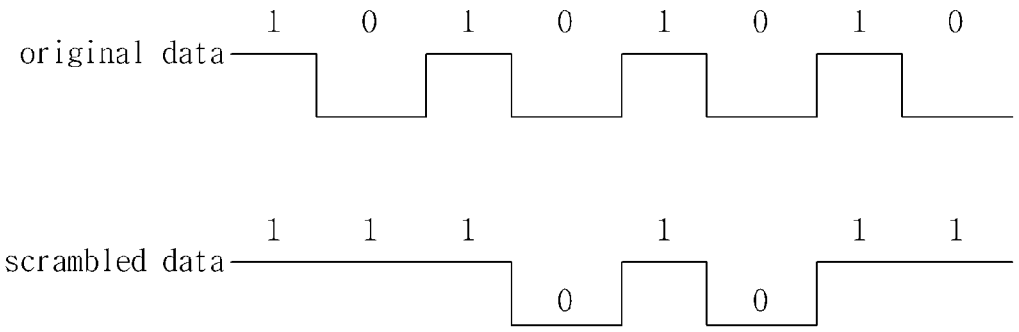
FIG. 4 is a timing diagram conceptually illustrating forms of original data and scrambled data.

FIG. 4 is a timing diagram conceptually illustrating forms of original data and scrambled data.

Referring to FIG. 4, the AP 110 intends to transmit a binary signal '10101010' of original data to the TCON 120. Here, the original data '10101010' is scrambled to '11101011' to be transmitted. That is, a specific key value, e.g., '1010', is secured based on other identifiers for scrambling data. To this end, in addition to data security, data scrambling brings an effect that a period of a first frequency f1, which is a frequency period of data, is changed to become slower than a period preset desired (or, alternatively predetermined) in the AP 110, thereby decreasing data noise. Of course, the scrambled data may be received after descrambling the data by the TCON 120 to restore to the original data. Thus, when the original data, which is scrambled to be transmitted by the AP 110, is completely restored by the TCON 120 and is read as the original data, the noise-free data is transmitted. Therefore, the first frequency f1 may be newly set as a varied period in the AP 110.

Meanwhile, the scrambling method may use, for example, a scramble/descramble circuit.

When noise is generated in data transmitted from the AP 110 to the TCON 120 although the first filtering operation of the frequency noise was performed, a second filtering operation of the frequency noise may be performed.

For the second filtering operation of the frequency noise, a spread spectrum clock generation technology, which generates a modulation frequency, is performed by modulating a frequency of the original signal with a desired (or, alternatively a predetermined) modulation ratio.

The spread spectrum clock generation technology is to evenly spread energy concentrated in a specific frequency through a broader frequency band by modulating a frequency of a clock signal. The noise of the signal may be decreased by using the spread spectrum clock generation technology.

Figure 5A:
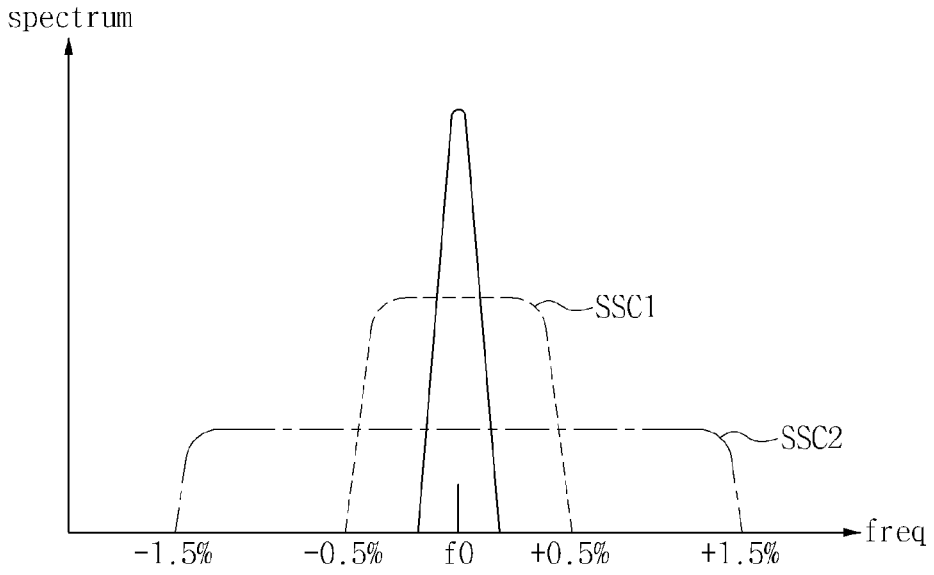
FIG. 5A is an example graph illustrating spread spectrum clocks.
Figure 5B:
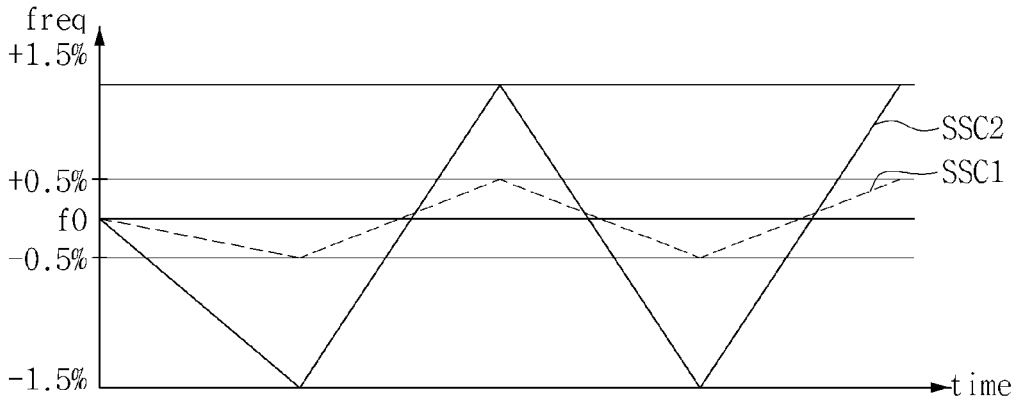
FIG. 5B is a graph illustrating time vs. frequency from the graph of the FIG. 5A.

Referring to FIGS. 5A and 5B, the spread spectrum clock generation technology will be described in more detail.

FIG. 5A is an example graph illustrating spread spectrum clocks.

Referring to FIG. 5A, an X axis denotes a frequency and a Y axis denotes a spectrum band. A first modulation frequency SSC1 having a first modulation ratio of −0.5 to +0.5% may be generated based on a basic frequency f0, as the spread spectrum clock. Also, a second modulation frequency SSC2 having a second modulation ratio of −1.5 to +1.5% may be generated based on the first modulation frequency SSC1. In one embodiment, f0 may be the frequency or band determined after the data scramble filtering operation of FIG. 4.

It shows that a frequency band of the first modulation frequency SSC1 is more expanded compared to that of the basic frequency f0, and a frequency band of the second modulation frequency SSC2 is greater than the first modulation frequency SSC1. Here, it may be known that energy concentrated in a specific frequency is expanded to a broader frequency band by shifting or spreading an original frequency. Therefore, the data noise is decreased.

In addition, spread spectrum clocks having various modulation ratios and modulation frequencies may be generated according to a user's intension.

FIG. 5B is a graph illustrating time vs. frequency while showing a relationship of the basic frequency f0, the first modulation frequency SSC1 and the second modulation frequency SSC2 in the graph of FIG. 5A.

Referring to FIG. 5B, an X axis denotes time and a Y axis denotes frequency.

Showing the basic frequency f0, the first modulation frequency SSC1 and the second modulation frequency SSC2 according to a change in time, it may be seen that the basic frequency f0 has a constant frequency over time. However, it shows that a period of the first modulation frequency SSC1 varies over time, compared to the basic frequency f0. It also shows that a period change of the second modulation frequency SSC2 over time is greater, compared to the first modulation frequency SSC1. Therefore, the spread spectrum clock may be generated by setting the respective first to third frequencies f1 to f3 associated with the basic frequency f0 and modulating them at a desired (or, alternatively a predetermined) modulation ratio.

In one embodiment, the AP 110 modulates the first frequency f1 at a desired (or, alternatively predetermined) modulation ratio and provides data to the TCON 120 using the expanded modulation frequencies, such as the first and second modulation frequencies SSC1 and SSC2, thereby decreasing noise of the data. Therefore, when it is determined that the data noise is decreased through the second filtering operation of the frequency noise, one of the first and second modulation frequencies SSC1 and SSC2 may be set as the first frequency f1 having newly varied period signal in the AP 110.

Meanwhile, a circuit for generating the spread spectrum clock, for example, may use a circuit using a phase locked loop (PLL).

When the noise is still generated in the data although the second filtering operation of the frequency noise was performed, a third filtering operation of the frequency noise may be performed.

The third filtering operation of the frequency noise may be performed by software or hardware.

For example, it may be determined whether the noise is generated in the data by changing a range of the first frequency f1 at desired (or, alternatively predetermined) steps, e.g., at intervals of 1 MHz or 10 MHz.

In one embodiment, the first frequency may be that determined after the spread spectrum filtering operation of FIG. 5A-5B.

Furthermore, it may be determined whether the noise is generated in the data using the first frequency f1, by providing a noise sensor in hardware.

Various methods for determining noise may be implemented according to a designer's intension, and the example embodiments of the inventive concepts are not limited thereto. However, it will be understood as satisfying an aspect of the inventive concepts when minimum and maximum values of the first frequency f1 improved or optimized by an operation of the third filtering operation are detected.

Figure 6:
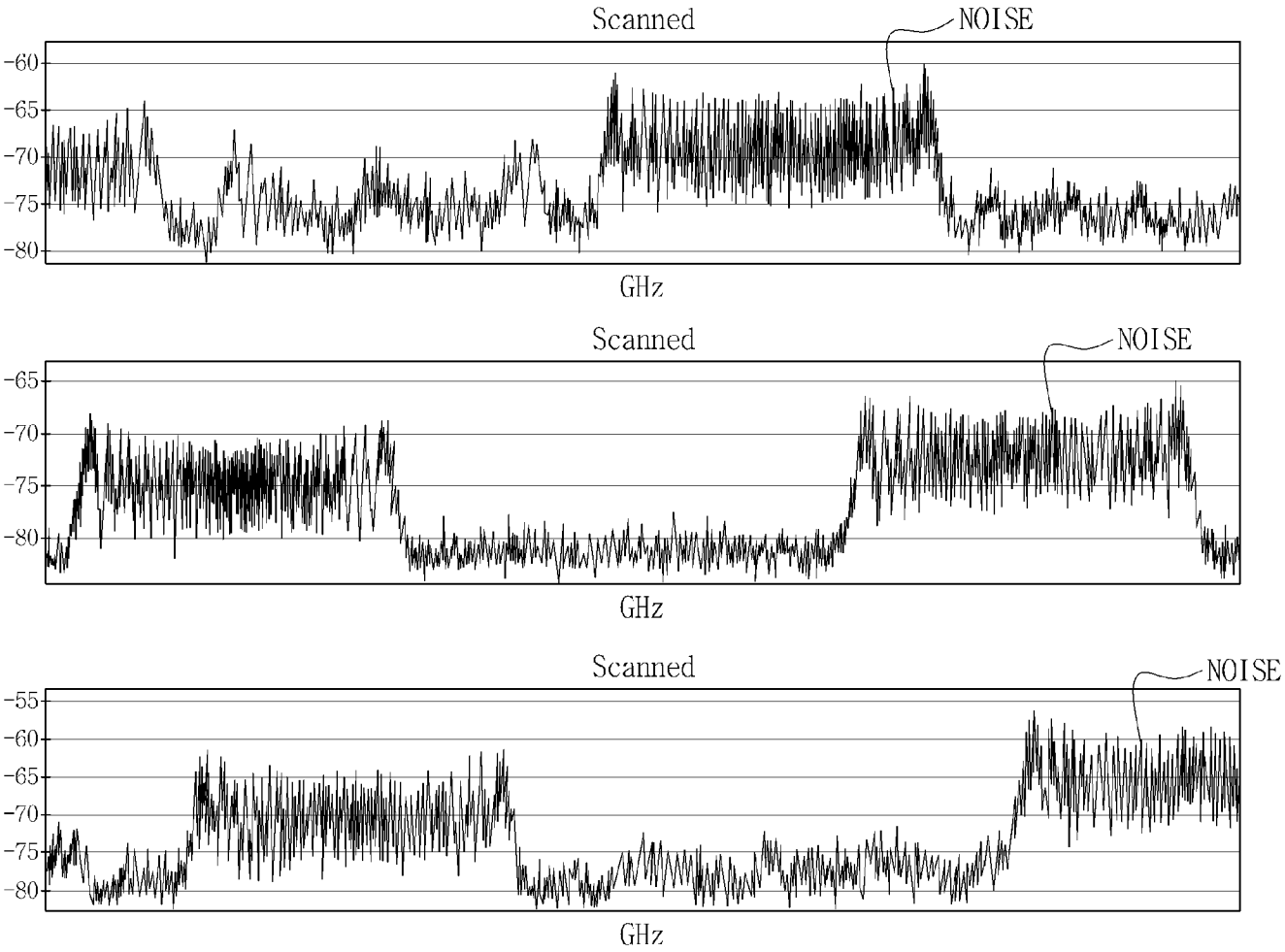
FIG. 6 is a simulation graph showing determined data noise of a first frequency.

FIG. 6 is a simulation graph illustrating data noise determined by changing a range of a first frequency at a desired (or, alternatively a predetermined) step.

Referring to FIG. 6, it illustrates that a position where the noise is generated is also changed when the first frequency f1 is changed to the desired range.

By repeatedly determining the above several times, a range between minimum and maximum values of a final frequency, where the noise of the first frequency (f1) is not involved, may be detected.

FIG. 7 is a simulation diagram for analyzing noise characteristics in the AP (110).

Referring to FIG. 7, a horizontal entry denotes a frequency and a vertical entry denotes a mode according to each communication environment.

For example, A, B, and C may be test stages and the detailed items represented as 1, 2, and 3 in each stage may be application modes.

Referring to FIG. 7, 'a', which is filled the most darkly, denotes that an occurrence frequency of noise is high; 'b', which is lighter than 'a' denotes that the occurrence frequency of noise is intermediate; and 'c', which is lighter than 'b' denotes that the occurrence frequency of noise is low. Since a criterion of the occurrence frequency of noise may vary according to a size of glass for each panel and a length of a data pattern, a specific implementation numbers are not mentioned.

Referring to FIG. 7, 'A' among 'A', 'B', and 'C' may be analyzed as having the best characteristics of noise.

The AP 110 analyzes the frequency band of 'A', where the noise is decreased, and detects the minimum and maximum values of the first frequency f1. For example, 100 KHz may be set as the minimum value and 100.8 KHz may be set as the maximum value. However, the AP 110 may set a range more suitable for a device or a circumstance, e.g., a range between 99.9 KHz and 101 KHz, for the range of the first frequency f1.

According to an example embodiment of the inventive concepts, the AP 110 may search for a frequency band which is substantially the most suitable for a communication environment and conditions of a base station and vary respective frequencies f1, f2, and f3 to be operated. That is, although the communication environment and the conditions of the base station change, a data communication having low noise is performed by avoiding a frequency band being influenced by noise so that decreases in an image quality and a communication quality may be mitigated or prevented.

As described above, conventionally, since a communication is performed in the fixed frequency band even when the communication environment and the base station are changed, communication quality becomes lower or a flicker phenomenon on an image may be generated. According to an embodiment of the inventive concepts, however, various methods for varying frequencies in order to decrease noise are performed so that an improved or optimized frequency band may be used.

Figure 8:
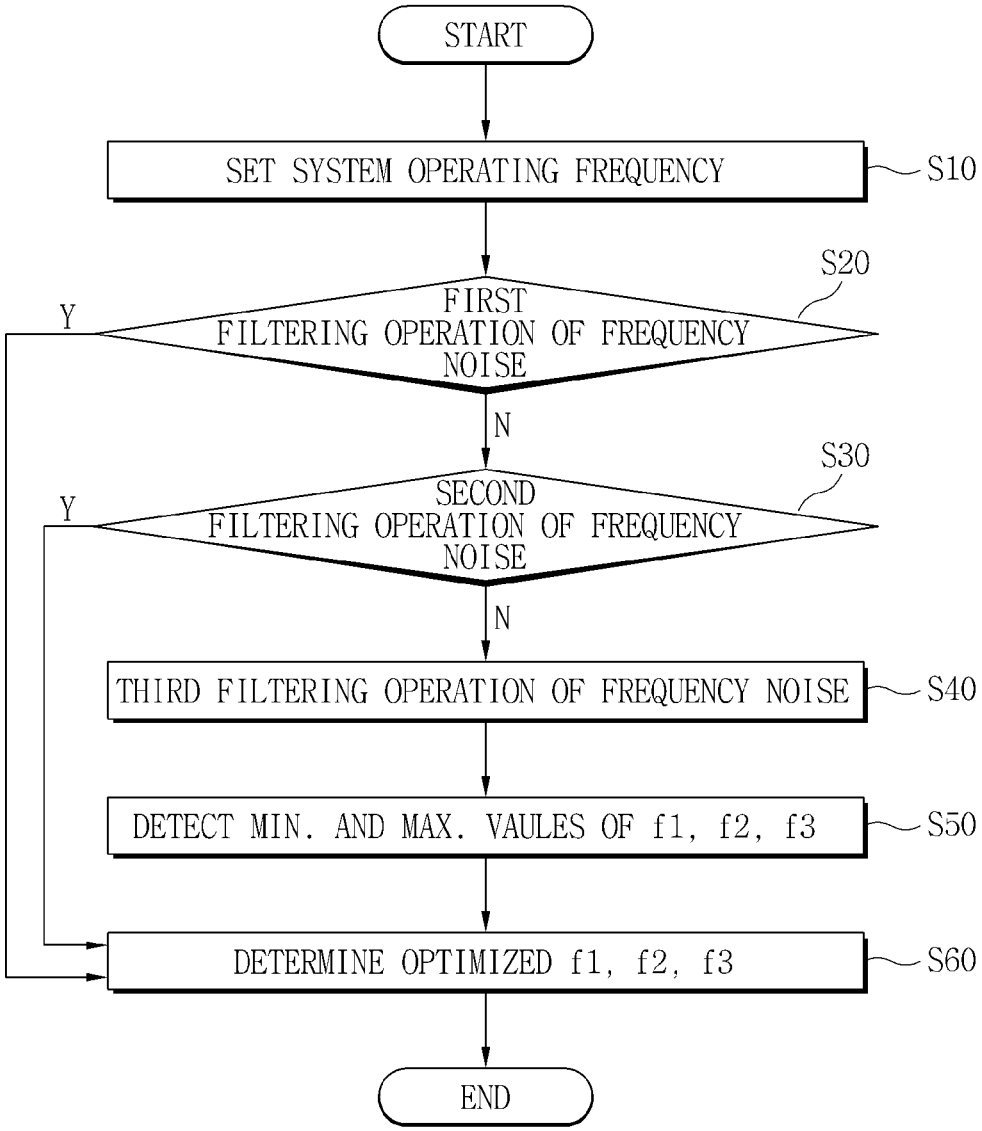
FIG. 8 is a flow chart illustrating a method of controlling an operation according to FIG. 3.

FIG. 8 is a flow chart showing a method of controlling an operation according to FIG. 3.

Referring to FIG. 8, a system operating frequency is set (S10).

The AP 110 may set the system operating frequency according to specifications of a corresponding device. The AP 110 may firstly set a frequency according to specifications or standards for the system operating frequency.

Before transmitting or receiving data, whether data noise is removed or not is determined through a first filtering operation of a frequency noise (S20).

The first filtering operation of the frequency noise uses a data scramble. Respective frequencies, i.e., first to third frequencies f1 to f3, are determined by the data scramble.

When the noise of the data is removed by the data scramble, the AP 110 determines the frequency as the desired improved or optimized frequency and selects the corresponding frequency to be used.

When the noise of the data is not removed by the data scramble, whether the noise of the data is removed or not is determined through a second filtering operation of the frequency noise (S30). The second filtering operation is applied to a result of the first filtering operation. Determining whether noise is removed or not in this or other steps may be performed in any well-known manner. For example, a well-known noise detector may detect the noise level and compare the detected noise level to a noise level threshold. If the detected noise level is less than or equal to the noise level threshold than noise has been sufficiently removed; otherwise, noise has not been sufficiently removed. The noise level threshold may be a design parameter selected by empirical study.

The second filtering operation of the frequency noise uses a spread spectrum clock generation technology.

That is, the first to third frequencies f1 to f3 are determined using the spread spectrum clock generation technology described in detail with respect to FIGS. 5A-5B.

When the noise of the data is removed by generating the spread spectrum clock, the AP 110 determines the frequency as the improved or optimized frequency and selects the corresponding frequency to be used.

When the noise of the data is not removed by generating the spread spectrum clock, a third filtering operation of the frequency noise is performed (S40). The third filtering operation is performed on results of the second filtering operation.

The third filtering operation may be performed by determining whether the data noise exists by iteratively changing the spread spectrum clock at a desired frequency unit (e.g., 11 MHZ) for a desired number of iterations until the noise is removed or using a noise sensor circuit.

The respective first to third frequencies f1 to f3 are determined through the third filtering operation of the frequency noise.

Therefore, the AP 110 detects ranges of the respective frequencies of the area where the noise is decreased, i.e., the minimum and maximum values of the first frequency f1, the minimum and maximum values of the second frequency f2, the minimum and maximum values of the third frequency f3 (S50).

The AP 110 determines the first to third frequencies f1 to f3, of which ranges are newly changed, as operating frequencies of a corresponding environment and supports all operations (S60).

An embodiment of the inventive concepts provides the AP 110 that determines whether the noise of the data exists through the respective frequencies and performs filtering of the frequency noise to support all operations with a varied frequency signal, which is a final suitable frequency range. Here, since the AP 110 unilaterally performs a process of generating control signals this operation is defined as a single-way mode.

Another embodiment of the inventive concepts provides a process of generating control signals that may be performed by the display module 180 (see FIG. 3) at a receiving side, i.e., as two-way mode which is capable of feedback, as an example.

Figure 9:
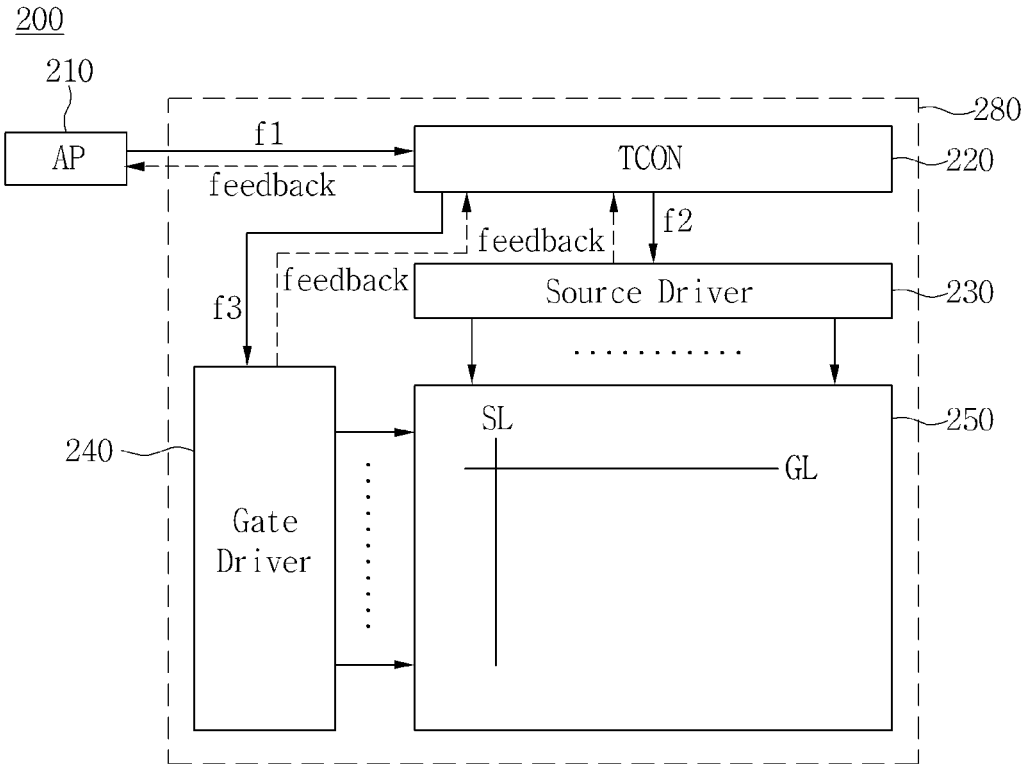
FIG. 9 is a block diagram of a DDI in accordance with another embodiment of the inventive concepts.

FIG. 9 is a block diagram of a DDI in accordance with another embodiment of the inventive concepts.

Referring to FIG. 9, the DDI (200) includes an AP 210 and a display module 280. The display module 280 includes a TCON 220, a source driver 230, a gate driver 240 and a panel 250.

In the DDI 200 according to another embodiment of the inventive concepts, data frequencies transmitted from the AP 210 to the TCON 220, from the TCON 220 to the source driver 230, and from the TCON 220 to the gate driver 240 are variable according to the communication environment. Here, respective frequencies are defined as a first frequency f1, a second frequency f2, and a third frequency f3. Thus, the DDI 200 may detect a range of a frequency suitable for a receiving frequency environment of the display module 280 and control the AP 210 to newly apply first to third frequencies f1 to f3. The only difference from the previous embodiment of the inventive concepts is that the display module 280 at the receiving side provides feedback on each substantial corresponding frequency in a range to the AP 210 (refer to a dotted line).

That is, a basic operating frequency for each frequency may be initially set in the AP 210 according to the specifications. For example, a range of the basic operating frequency of the first frequency f1 is suggested as a range of 900 MHz to 1 GHz, however, when a range of the first frequency f1 where the display module substantially operates is in a range of 900 MHz to 920 MHz, 940 MHz to 960 MHz, or 960 MHz to 980 MHz, a feedback of this information may be provided to the AP 210.

In the previous embodiment of the inventive concepts, the AP 110 (see FIG. 3) controls all processes. However, in this embodiment of the inventive concepts, the display module 280 at the receiving side provides feedback information, thereby supporting a two-way mode.

Therefore, a range for determining frequencies by the AP 210 is substantially decreased, and thus time and resources for searching for a final frequency may be reduced.

The AP 210 according to another embodiment of the inventive concepts supports and controls overall operations of the DDI 200. The AP 210 provides data to the TCON 220 so that the TCON 220 detects a surrounding communication environment and supports an operation corresponding to the environment.

Here, when the frequency for transmitting data from the AP 210 to the TCON 220 is a first frequency f1, the first frequency f1 is a frequency varied in consideration of a condition of the TCON 220.

That is, the AP 210 searches for a frequency band where noise is substantially decreased in a basic frequency band required for transmitting the data and signal to the TCON 220, and transmits a signal based on the determined frequency. That is, the AP 210 may search for and apply the frequency band of the first frequency f1 and provide the signal to the TCON 220 through the frequency band.

Subsequently, the TCON 220 receives image data and various control signals from the outside to control operations of the source driver 230 and the gate driver 240. Although not illustrated, the various control signals include a horizontal sync signal, a vertical sync signal, a clock signal, etc.

The TCON 220, for example, outputs general control signals such as a drive signal for controlling the gate driver 240 and a drive signal for controlling the source driver 230 to control whether the gate driver 240 and the source driver 230 operate or not, respectively.

Therefore, in a one operation mode, the TCON 220 may control the gate driver 240 so that the gate driver 240 drives the gate lines GL in a continuous manner. Furthermore, the TCON 220 may control image data signals, input from the outside, to be applied selectively to each pixel arranged in the gate lines GL, which are sequentially activated.

Likewise, the TCON 220 may provide control signals to the source driver 230 and the gate driver 240 through the second frequency f2 and third frequency f3, respectively. Here, the second frequency f2 and the third frequency f3 may be newly varied to ranges of the respective frequencies, where noise is decreased, by considering a substantial frequency environment of the source driver 230 and the gate driver 240, similar to the first frequency f1.

Hereinafter, general operations of the source driver 230 and the gate driver 240 will be briefly described to avoid a duplicated description since it is the same as that described in FIG. 2.

The source driver 230 includes a plurality of output amplifiers configured to drive source lines SL. The source driver 230 is controlled by the TCON 220 and provides the image data through a period of the second frequency f2.

The gate driver 240 includes a plurality of gate drivers configured to drive the gate lines GL. The gate driver 240 sequentially inputs a turn-on voltage to the gate lines GL through a period of the third frequency f3.

The panel 250 is controlled by the gate driver 240 and the source driver 230 to display images through pixels.

Searching for an improved or optimized frequency range is the same as the previous embodiment of the inventive concepts. However, it is different in that the filtering is performed within a range where a window selected for determining a frequency is reduced.

First, data scrambling is performed to firstly filter noise generated in each frequency.

When the noise is not removed although the first filtering operation of the frequency noise was performed, a second filtering operation of the frequency noise is performed on the results of the first filtering operation.

The second filtering operation of noise of the frequency uses a spread spectrum clock generation technology.

When a noise is not removed although the second filtering operation of the frequency noise was performed, a third filtering operation of the frequency noise is performed on the results of the second filtering operation.

The third filtering operation of frequency noise may be performed by determining whether the data noise exists by changing intervals of a desired (or, alternatively a predetermined) frequency unit or using a noise sensor circuit.

Respective first to third frequencies f1 to f3 are determined through the third filtering operation of the frequency noise.

The above is repeated for a desired (or, alternatively predetermined) number of times until an area where the noise is decreased is detected.

The AP 210 may select, apply and control a corresponding frequency band by analyzing an improved or optimized frequency band.

Figure 10:
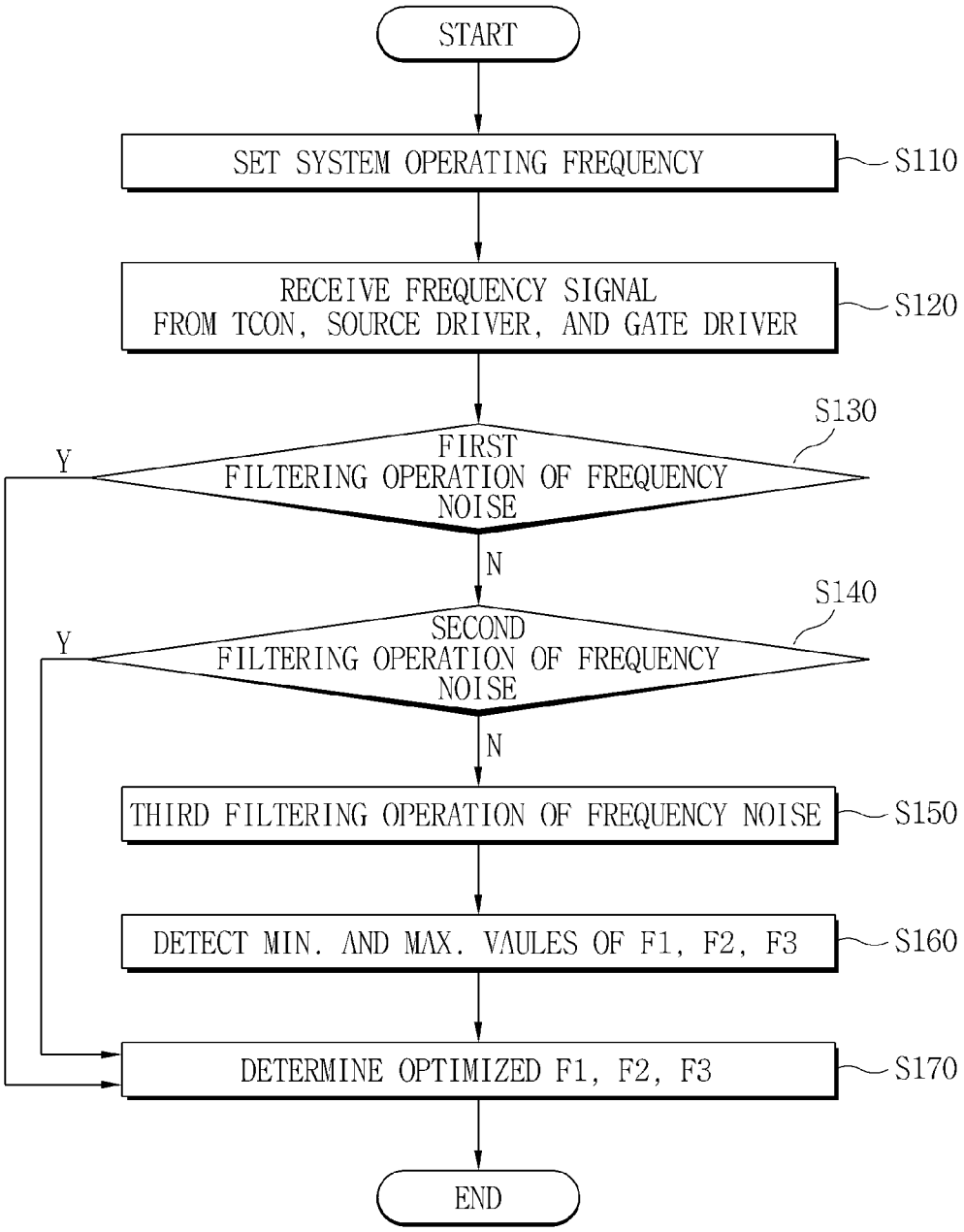
FIG. 10 is a flow chart illustrating a method of controlling an operation according to FIG. 9.

FIG. 10 is a flow chart illustrating a method of controlling an operation according to FIG. 9.

Referring to FIGS. 9 and 10, a system operating frequency is set (S110).

The AP 210 may set the system operating frequency according to specifications of the corresponding device.

Meanwhile, the display module 280 provides feedback of respective substantial frequency bands of the first to third frequencies f1 to f3 to the AP 210 (S120).

Whether noise of the data is removed or not is determined using a first filtering operation of the frequency noise within a range where the window for determining frequency is adjusted (S130).

The first filtering operation of the frequency noise uses a data scramble. The respective frequencies, i.e., the first to third frequencies f1 to f3, are determined by the data scramble.

When the noise of the data is removed in a frequency by the data scramble, the AP (210) determines the frequency as the improved or optimized frequency and selects the corresponding frequency to be used (S170).

When the noise of the data is not removed by the data scramble, whether the noise of the data is removed or not is determined through a second filtering operation of the frequency noise (S140) on the results of the first filtering operation.

The second filtering operation of the frequency noise uses a spread spectrum clock generation technology.

That is, the first to third frequencies f1 to f3 are determined using the spread spectrum clock generation technology.

When the noise of the data is removed in a frequency by generating the spread spectrum clock, the AP 210 determines the frequency as the improved or optimized frequency and selects the corresponding frequency to be used (S170).

When the noise of the data is not removed by the data scramble, a third filtering operation of the frequency noise is performed (S150) on the results of the second filtering operation.

The third filtering operation may be performed by determining whether the data noise exists by changing intervals of a desired (or, alternatively a predetermined) frequency unit or using a noise sensor circuit.

The respective first to third frequencies f1 to f3 are determined through the third filtering operation of the frequency noise.

The above is repeated for a desired (or, alternatively a predetermined) number of times until an area where the noise is decreased is detected.

Therefore, the AP 210 detects ranges of the respective frequencies of the area where the noise is decreased, i.e., the minimum and maximum values of the first frequency f1, the minimum and maximum values of the second frequency f2, the minimum and maximum values of the third frequency f3 (S160).

The AP 210 determines the first to third frequencies f1 to f3, of which ranges are changed, for an operating frequency of a corresponding environment and supports all operations (S170).

Figure 11:
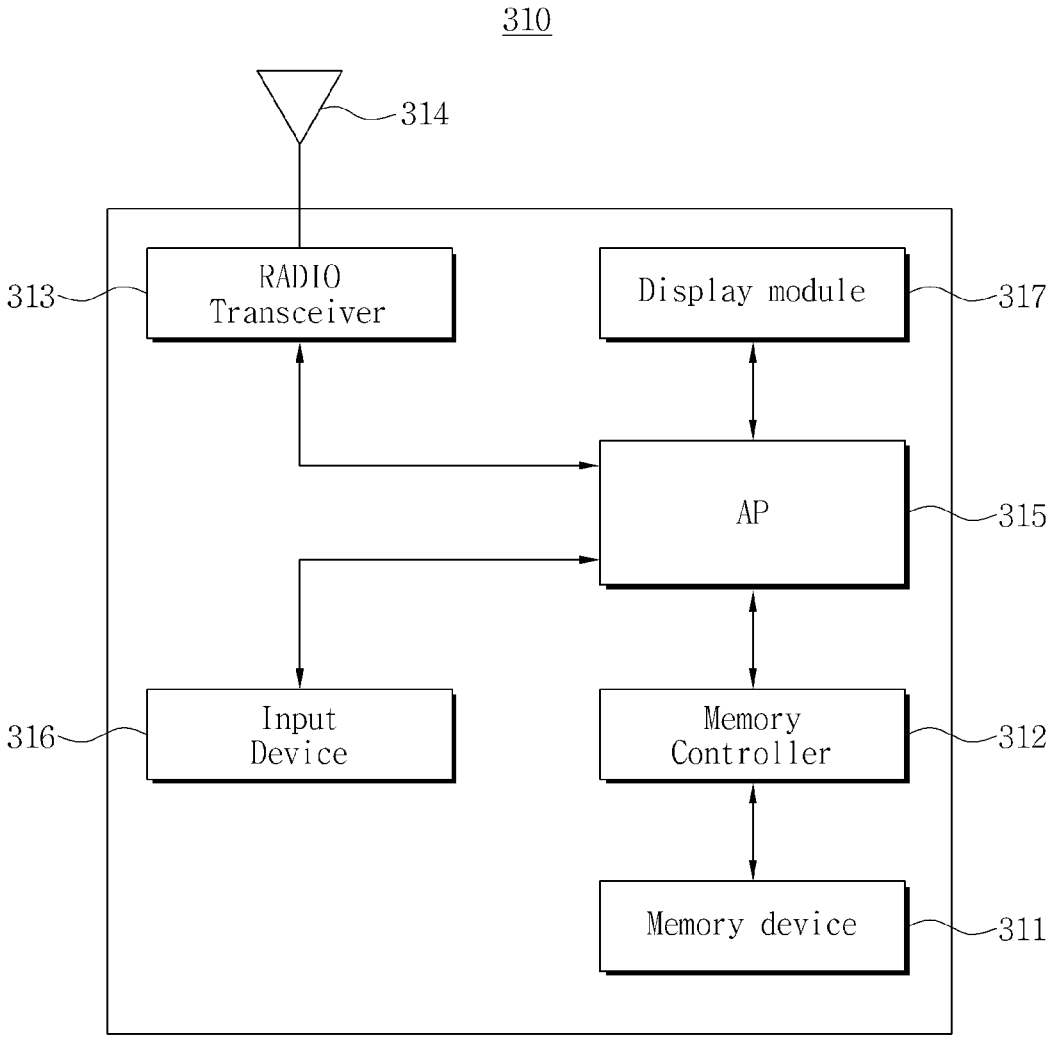
FIG. 11 is a block diagram of a computer system including an application processor and a display module shown in FIG. 3 in accordance with an embodiment of the inventive concepts.

FIG. 11 is a block diagram of a computer system 310 including the AP 110 and the display module 180 shown in FIG. 3 in accordance with an embodiment of the inventive concepts.

Referring to FIG. 11, the computer system 310 includes a memory device 311, a memory controller 312 configured to control the memory device 311, a radio transceiver 313, an antenna 314, an AP 315, an input device 316, and a display module 317.

The radio transceiver 313 may transmit or receive a radio signal through the antenna 314. For example, the radio transceiver 313 may convert the radio signal received through the antenna 314 to a signal to be processed in the AP 315.

Accordingly, the AP 315 may process the signal output from the radio transceiver 313 and transmit the processed signal to the display module 317. Furthermore, the radio transceiver 313 may convert the signal output from the AP 315 to a radio signal and output the radio signal to an external device through the antenna 314.

The input device 316 may input a control signal for controlling an operation of the AP 315 or data to be processed by the AP 315. The input device 316 may be embodied in a pointing device such as a touch pad and a computer mouse, a keypad, or a keyboard.

In some embodiments, the memory controller 312 capable of controlling an operation of the memory device 311 may be embodied as a part of the AP 315 or embodied as a chip separate from the AP 315.

In some embodiments, the AP 315 and the display module 317 may be embodied in the AP 110 and the display module 180 shown in FIG. 3 to vary a frequency into a range of a frequency where the noise is decreased.

Figure 12:
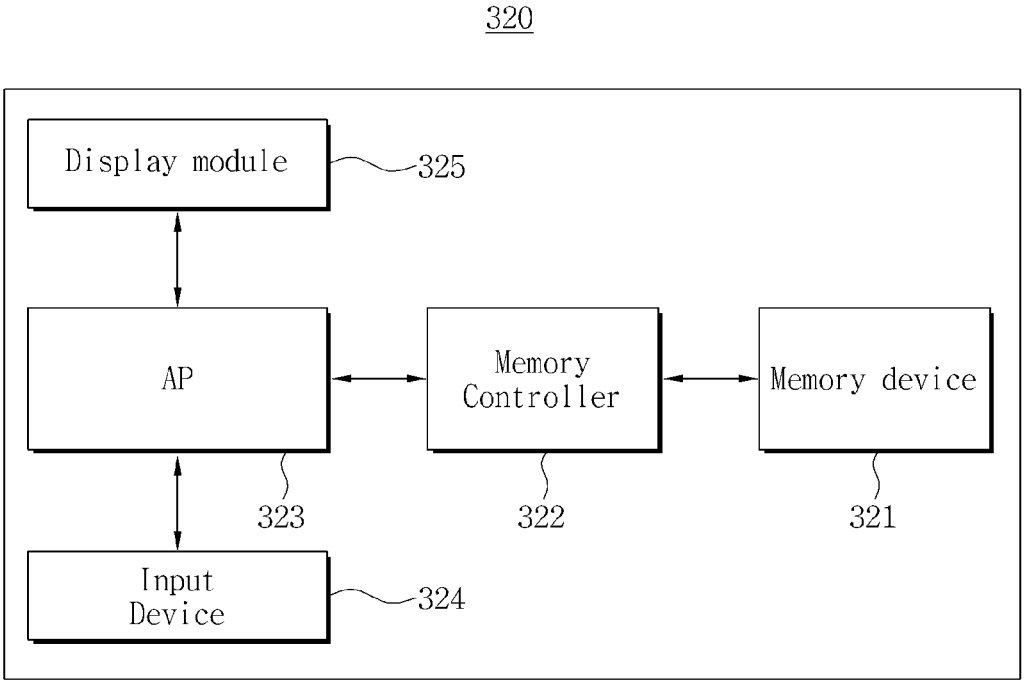
FIG. 12 is a block diagram of a computer system including the application processor and the display module shown in FIG. 3 in accordance with another embodiment of the inventive concepts.

FIG. 12 is a block diagram of a computer system including the AP 110 and the display module 180 shown in FIG. 3 in accordance with another embodiment of the inventive concepts.

Referring to FIG. 12, the computer system 320 may be embodied in a personal computer (PC), a network server, a tablet PC, a net-book, an e-reader, a personal digital assistant (PDA), a portable multimedia player (PMP), an MP3 Player, or an MP4 Player.

The computer system 320 includes a memory device 321, a memory controller 322 configured to control a data processing operation of the memory device 321, an AP 323, an input device 324 and a display module 325.

The AP 323 may display data stored in the memory device 321 through the display module 325 according to data input through the input device 324. For example, the input device 324 may be embodied in a pointing device such as a touch pad or a computer mouse, a keypad, or a keyboard. The AP 323 may control overall operations of the computer system 320 and an operation of the memory controller 322.

In some embodiments, the memory controller 322 capable of controlling an operation of the memory device 321 may be embodied as a part of the AP 323 or embodied as a chip separate from the AP 323.

In some embodiments, the AP 323 and the display module 325 may be embodied in the AP 110 and the display module 180 shown in FIG. 3 to vary a frequency into a range of a frequency where the noise is decreased.

Figure 13:
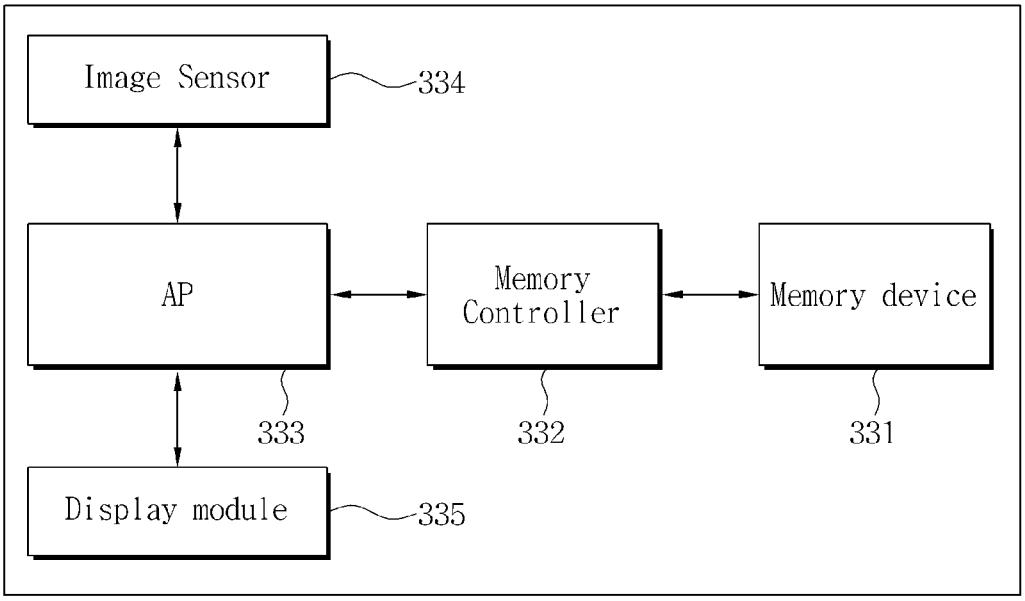
FIG. 13 is a block diagram of a computer system including the application processor and the display module shown in FIG. 3 in accordance with still another embodiment of the inventive concepts.

FIG. 13 is a block diagram of a computer system 330 including the AP 110, and the display module 180 shown in FIG. 3 in accordance with still another embodiment of the inventive concepts.

Referring to FIG. 13, the computer system 330 may be embodied in an image process device such as a digital camera or a mobile phone including the digital camera, a smart phone, or a tablet PC.

The computer system 330 includes a memory device 331 and a memory controller 332 capable of controlling a data processing operation of the memory device (331), e.g., a write operation or a read operation. Furthermore, the computer system 330 further includes an AP 333, an image sensor 334 and a display module 335.

The image sensor 334 of the computer system 330 converts an optical image into digital signals and the converted digital signals are transmitted to the AP 333 or the memory controller 332. The converted digital signals may be displayed through the display module 335 or may be stored in the memory device 331 through the memory controller 332, according to control of the AP 333.

Furthermore, the data stored in the memory device 331 is displayed through the display module 335 according to control of the AP 333 or control of the memory controller 332.

In some embodiments, the memory controller 332 capable of controlling the operation of the memory device 331 may be embodied as a part of the AP 333 or embodied as a chip separate from the AP 333.

In some embodiments, the AP 333 and the display module 335 may be embodied in the AP 110 and the display module 180 shown in FIG. 3 to vary a frequency into a range of a frequency where the noise is decreased.

A method of controlling the display driver IC according to the embodiment of the inventive concepts may include decreasing data noise by changing a desired (or, alternatively predetermined) frequency band to a substantial improved or optimized frequency band suitable for the surrounding communication environment and a base station environment. Furthermore, a communication quality and an image quality of the display driver IC may be improved since the data noise is decreased.

The foregoing is illustrative of embodiments and is not to be construed as limiting thereof. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

The inventive concepts may be applied to a display device, and more particularly, to a display driver IC.

Although a few embodiments have been described, those skilled in the art will readily appreciate that many modifications are possible in embodiments without materially departing from the novel teachings and advantages.

What is claimed is:

1. A method of controlling a display driver IC, comprising:

changing an operating frequency of data transmitted from an application processor to a timing controller, from the timing controller to a source driver, and from the timing controller to a gate driver to a new frequency range in response to a communication environment; and performing frequency noise filtering operations to detect a frequency range in which noise is decreased with respect to each of a first frequency, a second frequency, and a third frequency, the first frequency referring to an operating frequency between the application processor and the timing controller, the second frequency referring to an operating frequency between the timing controller and the source driver, and the third frequency referring to an operating frequency between the timing controller and the gate driver.

2. The method of claim 1, wherein the performing of the frequency noise filtering operations comprise performing a first frequency noise filtering operation, selectively performing a second frequency noise filtering operation, and a selectively performing third frequency noise filtering operation.

3. The method of claim 2, comprising:

performing the second frequency noise filtering operation in response to a frequency range in which noise is decreased being not sufficiently filtered out through the first frequency noise filtering operation.

4. The method of claim 3, wherein the first frequency noise filtering operation is performed using a data scramble.

5. The method of claim 3, wherein the second frequency noise filtering operation is performed using a spread spectrum clock generation technology.

6. The method of claim 5, wherein the spread spectrum clock generation technology comprises setting each of the first to third frequencies to a basic frequency and spreading a clock with a modulation ratio.

7. The method of claim 2, comprising:

performing the third frequency noise filtering operation in response to a frequency range in which noise is decreased being not sufficiently filtered out through the second frequency noise filtering operation.

8. The method of claim 7, wherein the third frequency noise filtering operation comprises checking data noise at intervals of a frequency unit and detecting minimum and maximum values of a corresponding operating frequency.

9. The method of claim 8, wherein the third frequency noise filtering operation is performed using software or hardware.

* * * * *